US008033204B2

(12) United States Patent
Bucks

(10) Patent No.: US 8,033,204 B2
(45) Date of Patent: Oct. 11, 2011

(54) KNIFE AND CUTTING WHEEL FOR A FOOD PRODUCT SLICING APPARATUS

(75) Inventor: Brent L. Bucks, Lakewood Ranch, FL (US)

(73) Assignee: Urschel Laboratories, Inc., Valparaiso, IN (US)

( * ) Notice: Subject to any disclaimer, the term of this patent is extended or adjusted under 35 U.S.C. 154(b) by 0 days.

(21) Appl. No.: 12/755,788

(22) Filed: Apr. 7, 2010

(65) Prior Publication Data

US 2010/0206185 A1 Aug. 19, 2010

Related U.S. Application Data

(60) Division of application No. 11/905,644, filed on Oct. 3, 2007, now Pat. No. 7,721,637, which is a continuation of application No. 10/878,047, filed on Jun. 29, 2004, now abandoned.

(60) Provisional application No. 60/484,054, filed on Jul. 2, 2003, provisional application No. 60/485,726, filed on Jul. 10, 2003.

(51) Int. Cl.
*B26D 1/12* (2006.01)

(52) U.S. Cl. ..... 83/663; 83/678; 83/932; 83/349; 83/403

(58) Field of Classification Search ..... 83/591, 83/592, 663, 678, 676, 596, 932, 356.3, 672, 83/698.41, 403, 349; 241/84, 85, 242
See application file for complete search history.

(56) References Cited

U.S. PATENT DOCUMENTS

| | | | | |
|---|---|---|---|---|
| 118,235 | A | 8/1871 | Harnish | |
| 419,364 | A | 1/1890 | Schoell | |
| 2,482,523 | A | 9/1949 | Urschel at al. | |
| 3,516,312 | A | 6/1970 | Nordberg et al. | |
| 3,521,688 | A | 7/1970 | Urschel et al. | |
| 3,623,525 | A | 11/1971 | Kieves | |
| 3,913,643 | A * | 10/1975 | Lambert | 144/172 |
| 4,523,503 | A | 6/1985 | Julian et al. | |
| 4,584,919 | A * | 4/1986 | Bittner | 83/663 |
| 4,648,296 | A * | 3/1987 | Wisdom et al. | 83/13 |
| 4,813,317 | A | 3/1989 | Urschel et al. | |
| 4,937,084 | A | 6/1990 | Julian | |
| 5,009,141 | A | 4/1991 | Julian et al. | |
| 5,125,308 | A | 6/1992 | Mendenhall | |
| 5,191,819 | A | 3/1993 | Hoshi | |
| 5,337,640 | A | 8/1994 | Arnoth et al. | |
| 5,343,623 | A | 9/1994 | Cole et al. | |

(Continued)

FOREIGN PATENT DOCUMENTS

DE 397305 6/1924

*Primary Examiner* — Boyer D Ashley
*Assistant Examiner* — Omar Flores-Sánchez
(74) *Attorney, Agent, or Firm* — Bacon & Thomas, PLLC

(57) ABSTRACT

A cutting wheel using knives with slice thickness gauging surfaces defining, with the knife cutting edges, a thickness dimension of sliced food products and a throat dimension measured perpendicular to the wheel cutting plane between each knife cutting edge and the terminal edge of the adjacent gauging surface, wherein the knives each have a single primary bevel extending practically tangent to the cutting plane on the side of the knife facing towards the cutting plane and a smooth transition area on the opposite side of the knife, and the ratio of throat dimension to slice thickness dimension is 1 to 1.7.

2 Claims, 21 Drawing Sheets

U.S. PATENT DOCUMENTS 5,694,824 A 12/1997 Jack et al.
5,992,284 A 11/1999 Bucks
6,148,702 A 11/2000 Bucks
6,148,709 A 11/2000 Bucks
6,920,813 B2 7/2005 Bucks
7,178,440 B2 2/2007 Bucks

* cited by examiner

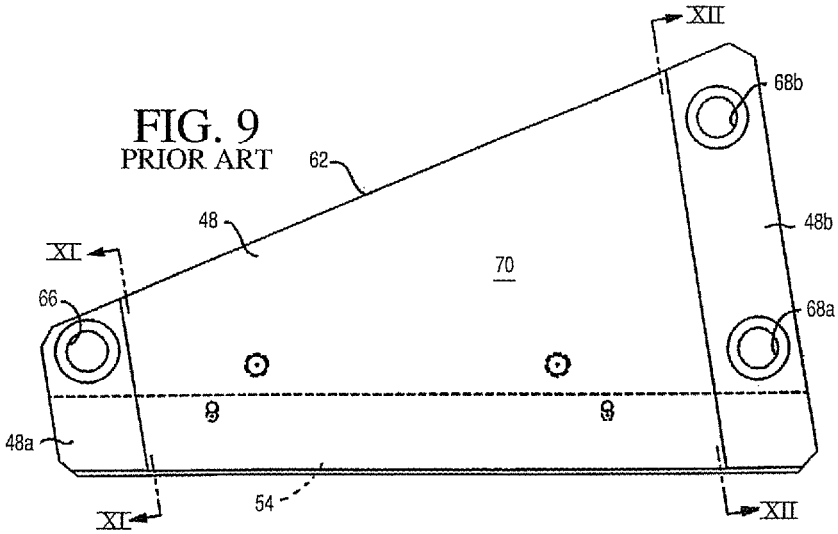
FIG. 9
PRIOR ART
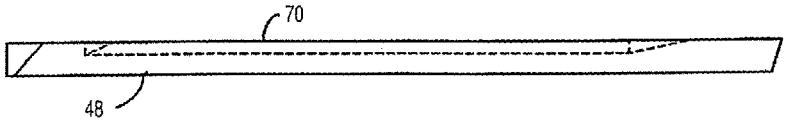
FIG. 10
PRIOR ART
FIG. 11
PRIOR ART
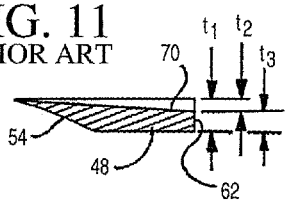
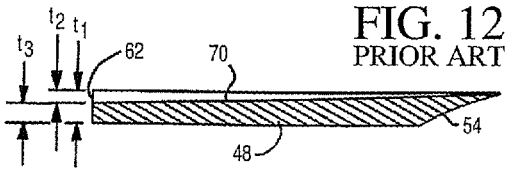
FIG. 12
PRIOR ART

KNIFE AND CUTTING WHEEL FOR A FOOD PRODUCT SLICING APPARATUS

This application is a division of application Ser. No. 11/905,644 filed Oct. 3, 2007, which is a continuation of application Ser. No. 10/878,047 filed Jun. 29, 2004, the entirety of which is incorporated herein by reference. The benefit of provisional application Nos. 60/484,054 filed Jul. 2, 2003 and 60/485,726 filed Jul. 10, 2003 is claimed under 35 U.S.C. 119(e).

BACKGROUND OF THE INVENTION

1. Field

The present invention relates to a knife arrangement for minimizing feathering of food products, in particular potatoes, during high speed cutting of the products.

2. Related Art

Food product slicing apparatus is known in which a food product is transported into a rotating wheel having a plurality of cutting knives such that the food product is cut into slices. In the food processing industry, in particular potato chip processing, it is vitally important that the food product be cut into slices having a uniform thickness with minimum or no damage of the food product. Such thickness uniformity facilitates the further processing of the food product giving a maximum amount of usable food product with a minimum amount of waste, and facilitates uniform baking, cooking and frying of the products after slicing of same.

Broadly, food slicing devices comprise those having a rotating wheel in which a plurality of knives extend between a hub and a rim, and the food product is fed through the cutting plane of the rotating wheel, and those having a drum in which the circumference of the drum comprises a plurality of shoes, each shoe having a cutting knife thereon wherein the cutting edge of one shoe is spaced from a trailing edge of an adjacent shoe to control the thicknesses of the sliced food product. In the drum-type of cutting devices, the food product is fed into the interior of the drum onto a rotating base and is driven by paddles or blades on the base and by centrifugal force into contact with the stationary axially extending cutting knives radially projecting towards the drum interior. Generally speaking, controlling the consistency of the thickness of food products sliced with the rotating wheel device requires accurate coordination between the rotating speed of the wheel, the spacing between the blades of the wheel and the feed rate of the food product.

The drum type of slicing apparatus accurately controls the thickness of the sliced food product, but cannot reach the desired high output volume without the possibility of damaging the food product. The output volume of these devices is limited by the rotational speed of the base, which must be limited to prevent possible damage to the food product by contact with the paddles or blades of the base. Another drawback associated with this type of slicing apparatus relates to the orientation of elongated food products. It is often desirable to slice an elongated food product either perpendicular to, or at an oblique angle relative to the longitudinal axis of the elongated food product. However, it is extremely difficult to properly orient elongated food products, which may have varying dimensions, both longitudinally and laterally, in the drum type of slicing apparatus in order to slice the food product in the desired orientation.

Typical, known cutting wheels are illustrated in FIGS. 1 and 2. A first type of known wheel illustrated in FIG. 1 comprises a hub 10, about which is concentrically arranged a rim 12, the hub and rim being interconnected by a plurality of knives 14. Each of the knives 14 has a cutting edge 16 facing in the direction of rotation of the wheel, indicated by arrow 18. The width W of each of the cutting knives 14 is relatively small thereby forming a radially extending space 20 between a trailing edge of one knife and the cutting edge of the adjacent knife having large dimensions in a circumferential direction. Not only is the space 20 between the knives relatively large, but the circumferential dimension of this space 20 is greater adjacent to the rim than adjacent to the hub.

A second type of known cutting wheel is illustrated in FIG. 2 wherein the hub 10 and the rim 12 are similar to the previously described cutting wheel, but cutting knives 22 have a greater width W. Again, the knives 22 each have a cutting edge 24 facing in the direction of rotation, illustrated by arrow 26. Although the radial space 28 between the cutting edge of one knife and a trailing edge of an adjacent knife is somewhat smaller than in the previously described known cutting wheel, the circumferential dimensions of the space 28 varies greatly between the rim and the hub.

Typically, the food product is transported at a food product receiving area through the cutting plane of the cutting wheel at a constant speed and the cutting wheel is rotated, also at a constant speed. The varying circumferential dimensions of the radial spaces 20 and 28 between the adjacent knives 14 and 24 render it difficult to achieve a desired high level of consistency in the thickness of the sliced food product.

Still other prior art knives for slicing food products in a rotary slicing machine are illustrated in FIGS. 3-7, wherein knives 30 that are formed triangular in shape or knives comprising triangular holders 48 supporting separate knife blade elements 50 are used to maintain a constant radial gap between adjacent knives mounted on a cutting wheel.

Still other examples of prior art knives suitable for use in cutting wheels are illustrated in FIGS. 10-19, wherein a gauging surface 70 is provided on the side of a slicing knife facing the uncut food product to control uniformity of slices cut by the knife. For a fuller description of the prior art cutting knives discussed above, reference may be made to U.S. Pat. No. 5,992,284 granted Nov. 30, 1999 and assigned to the owner of the present application. The text and drawings of U.S. Pat. No. 5,992,284 are hereby incorporated by reference in this description.

While the prior art knives incorporating gauging surfaces as described in U.S. Pat. No. 5,992,284 and illustrated in FIGS. 9-19 to be discussed in more detail below produce slices of food product having highly uniform and precise thicknesses, certain hard core food products such as potatoes intended for use in the production of food products such a potato chips or french fries were observed to contain cracks or fissures along the surface of the cut slice facing the cutting edge of the slicing knife, a phenomenon referred to as "feathering" in the food product diminution industry.

SUMMARY OF THE INVENTION

The present invention is based on the discovery that feathering of hard core food products such as potatoes cut in rotary or drum slicers using gauging surfaces can be minimized and virtually eliminated by controlling the ratio between slicing throat dimension and slice thickness, wherein the slicing throat dimension is the distance between the terminal edge of a gauging surface of a leading knife and the cutting edge of a trailing knife in a rotary slicing machine, measured parallel to the cutting plane of the knife, and the slice thickness is the distance between the cutting edge of a knife and the adjacent gauging surface terminal edge measured perpendicular to the cutting plane or axially relative to the rotary axis of the rotary or drum slices. In addition, control of feathering of sliced food products was obtained by changing the double bevel configuration of the prior art knife from a double primary bevel profile to a single primary bevel profile, with a smooth transition from cutting edge to knife body on the side of the knife opposite the bevel provided to minimize pressure applied to the cut slice at the cutting edge of the knife. The surface of the primary bevel is oriented substantially tangent to the knife cutting plane. A finish hone and back hone are provided at the cutting edge.

In accordance with the present invention, the ratio of throat dimension to slice thickness using the improved knife profile is 1 to 1.7 to produce slices having acceptable thickness precision and consistency, on the one hand, and reduction or absence of fissures, on the other hand.

BRIEF DESCRIPTION OF THE DRAWINGS

FIG. 9 is a bottom view of a known knife holder utilized with the knife illustrated in FIG. 7.

FIG. 10 is a front view of the knife holder illustrated in FIG. 9.

FIG. 11 is a cross-sectional view taken along line XI-XI in FIG. 9.

FIG. 12 is a cross-sectional view taken along line XII-XII in FIG. 9.

DETAILED DESCRIPTION OF THE PREFERRED EMBODIMENTS

Figure 1:
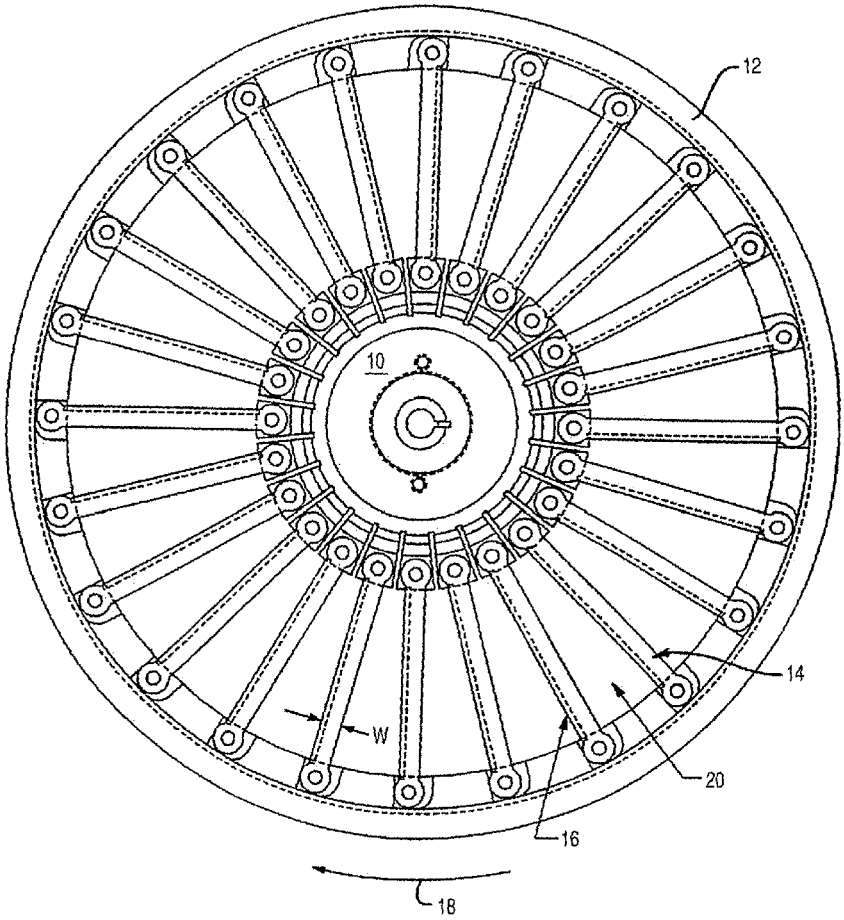
FIG. 1 PRIOR ART
FIG. 1 is a front view of a known type of cutting wheel.
Figure 2:
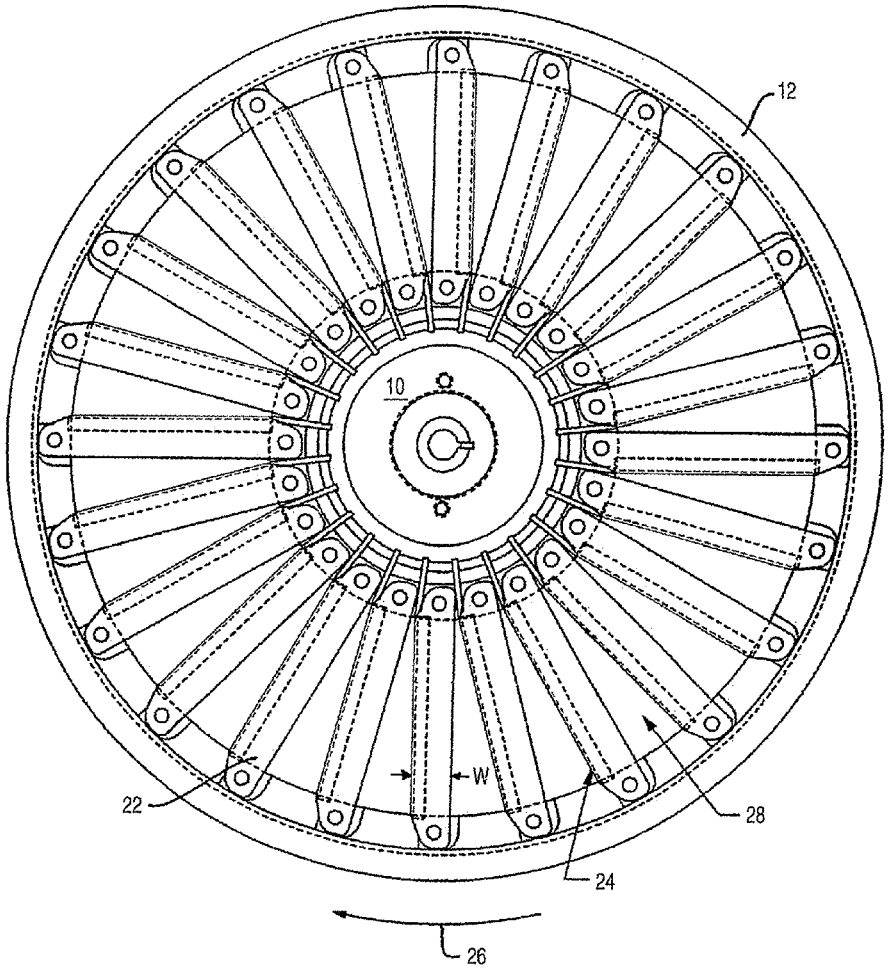
FIG. 2 PRIOR ART
FIG. 2 is a front view of another known type of cutting wheel.
Figure 3:
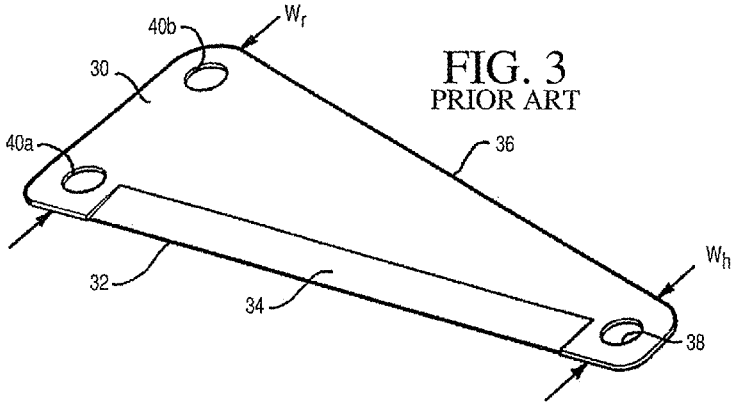
FIG. 3 PRIOR ART
FIG. 3 is a perspective view of a first embodiment of a prior art knife.

An example of a known knife arrangement is illustrated in FIG. 3. The knife 30 is formed from a single, planar piece of material, such as by cutting, stamping, etc., and has a cutting edge 32 formed thereon by a beveled surface 34. A second edge 36 is located opposite the cutting edge 32 and extends obliquely with respect to the cutting edge 32. A hub mounting hole 38 and rim mounting holes 40*a* and 40*b* are formed in opposite ends of the knife to attach the knife 30 to the hub and the rim of a cutting wheel. As can be seen, the width $W_h$ of the knife 30 at the hub end is less than the width $W_r$ of the blade at the rim end. This gives the knife 30 a generally triangular configuration. Except for the bevel surface 34, the thickness of the knife blade 30 is substantially constant throughout.

Figure 4:
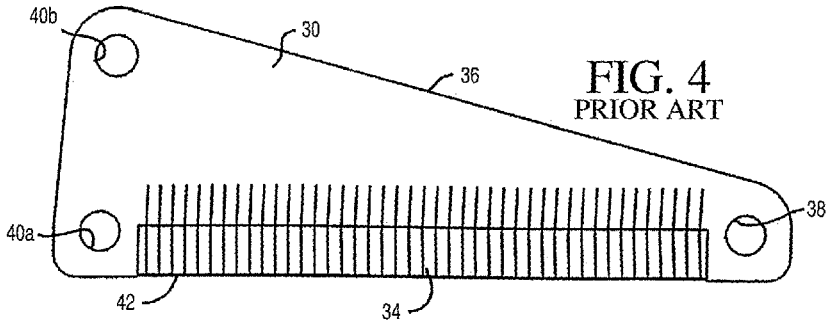
FIG. 4 PRIOR ART
FIG. 4 is a top view of a first variation of the knife illustrated in FIG. 3.
Figure 5:
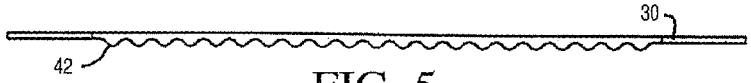
FIG. 5 PRIOR ART
FIG. 5 is a front view of the knife of FIG. 4.

The knife illustrated in FIG. 3 has a straight, linear cutting edge 32 for cutting food product slices having planar opposite sides. The cutting edge 32 may be convexly or concavely curved, or may be modified to form food product slices having "wavy" opposite surfaces or "V-shaped" grooves in opposite surfaces. A first variation is illustrated in FIGS. 4 and 5 with the knife having the identical configuration to the knife illustrated in FIG. 3, except for the cutting edge. In this particular example, the cutting edge 42 has a sinusoidal or "wavy" configuration extending along the length of the cutting edge comprising a series of curves having opposite curvatures. Blades of this configuration will form food product slices having "wavy" opposite major surfaces.

Figure 6:
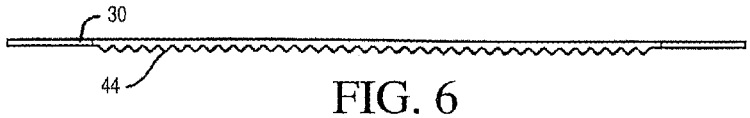
FIG. 6 PRIOR ART
FIG. 6 is a front view of a second variation of a prior art knife having a series of V-shapes along the cutting edge.

A second variation is illustrated in FIG. 6 wherein the cutting edge 44 comprises series of "V's" along the length of the cutting edge to form food product slices having V-shaped grooves in opposite major surfaces. When the knives are attached to a cutting wheel, the curves of cutting edge 42, or the "V's" of cutting edge 44 may be radially aligned with those of adjacent blades for forming appropriately shaped food slices. The cutting edges of alternative blades may also be formed or located such that the curves or "V's" of every other knife is out of radial alignment with adjacent knives if it is desired to form a shredded food product rather than a sliced food product.

Another prior art knife arrangement is illustrated in FIGS. 7-12. As can be seen, the knife 46 comprises a knife holder 48 on which knife blade 50 is mounted. The knife blade may be permanently attached to the knife holder, or may be removably held by clamp 52. Knife blade 50 is held against bevel surface 54 formed on the knife holder 48 by clamp 52, which is attached to the knife holder by fasteners 56. Clamp 52 may engage the fasteners 56 by way of keyhole-shaped slots 58 which enable the removal of the clamp 52 by merely loosening the fasteners 56 and moving the clamp 52 such that the heads of the fasteners 56 are aligned with the larger opening portion of the keyhole shaped slots 58 and then removing the clamp 52. This eliminates the need to completely remove the fasteners 56 from the knife holder 48. Locating studs 60 extend from the knife holder 48 and engage openings 50*a* and 50*b* in the knife blade 50 to properly locate the knife blade 50 on the knife holder 48.

Knife holder 48 has second edge 62 formed thereon and, as can be seen, the second edge 62 extends obliquely with respect to the cutting edge 64 of the knife blade 50. Knife holder 48 has hub mounting hole 66 and rim mounting holes 68*a* and 68*b* formed therein for attachment to the hub and rim, respectively, of a cutting wheel. As can be seen, the width of the knife holder 48 at the hub mounting end is less than the width of the knife holder 48 at the rim mounting end, as in the previously described embodiment.

As in the previously described knife arrangement, knife blade 50 may have a convexly or concavely curved cutting edge, or the cutting edge may be formed in a series of curves to impart a sinusoidal or "wavy" configuration to the cutting edge, or the cutting edge may comprise a series of "V's" along its length. If the curves and "V's" are radially aligned, the cutting wheel on which the knife blades are used will slice the food product into slices having either "wavy" opposite major surfaces, or slices having V-shaped grooves in opposite major surfaces. If the curves, or "V's" of alternating blades are placed out of radial alignment with the corresponding curves or "V's" in adjacent blades, the cutting wheel on which the knife blades are mounted will shred the food product.

Knife holder 48 has a gauging surface 70 on a side of the knife holder 48 which faces generally upstream of the direction of the food product travel towards the cutting wheel, the unsliced food product coming into contact with the gauging surface 70 of the knife as the knife passes through the food product. As illustrated in FIGS. 9-12, the gauging surface 70 extends to the second or trailing edge 62 of the knife holder. The opposite end mounting portions 48*a* and 48*b* of the knife holder have a substantially constant thickness $t_1$ throughout their width, except for the portion on which the bevel surface 54 is located. The amount of taper of the gauging surface 70 at the second edge 62 is the same for both ends of the knife holder 48. This dimension, $t_2$ is illustrated in FIGS. 11 and 12. Since the total dimension of the taper at the second edge 62 is the same, the angle of taper for the gauging surface 70 at the hub end 48*a* of the knife holder will be greater than at the rim end 48*b*, since the same taper dimension must be achieved across a shorter width. The thickness $t_3$ of the knife holder 48 along the length of the second edge 62 is substantially constant. The gate opening is formed by the distance between a cutting edge 64 of one knife and the juncture of the gauging surface 70 and the edge 62 of an adjacent knife measured perpendicular to the cutting plane P and axially of the cutting wheel carrying the knives described.

Figure 13:
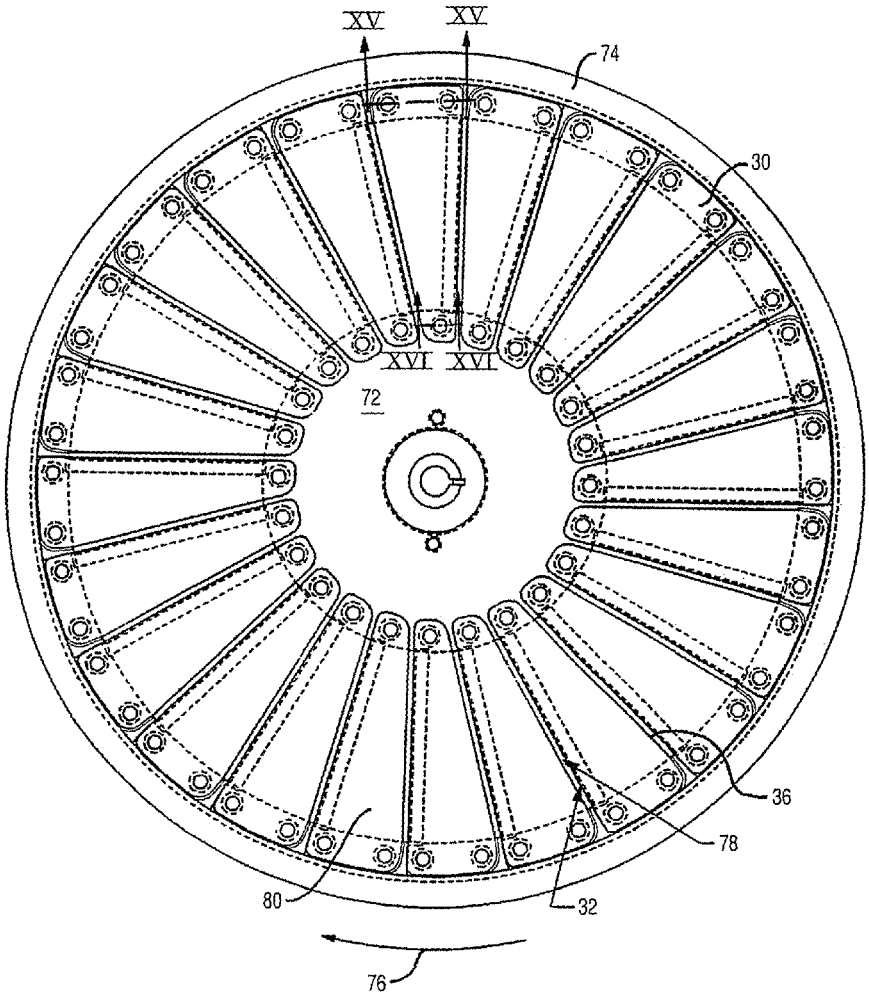
FIG. 13 PRIOR ART
FIG. 13 is a front view of a cutting wheel utilizing the knives of FIG. 3.
Figure 14:
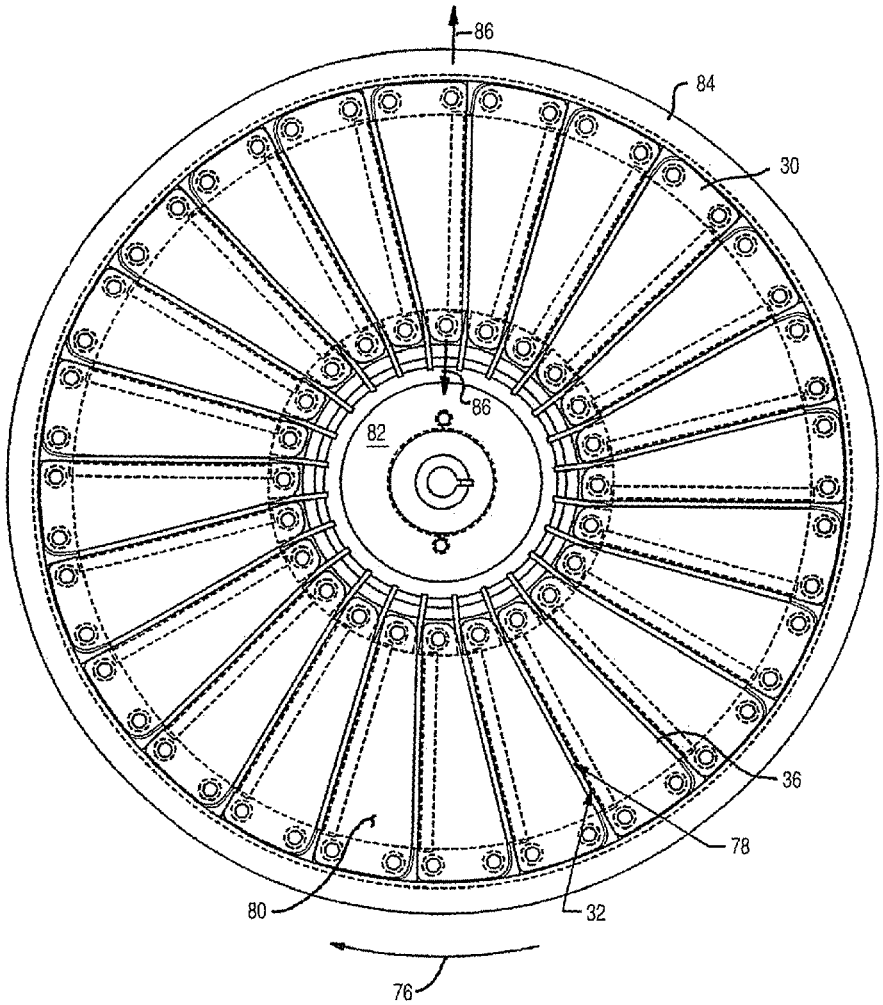
FIG. 14 PRIOR ART
FIG. 14 is a front view of a tension head cutting wheel utilizing the knives illustrated in FIG. 3.

FIGS. 13 and 14 are front views of two types of known cutting wheels on which are mounted a plurality of knives 30, as illustrated in FIG. 3. As can be seen, the first type of cutting wheel has a hub 72, a rim 74 and a plurality of knives 30 attached to the hub 72 and the rim 74. The cutting wheel rotates in the direction of arrow 76. The cutting edge 32 of each knife 30 is located adjacent to a second edge 36 of an adjacent knife 30. The second edge 36 extends substantially parallel to the cutting edge 32 of the adjacent knife 30 such that a radial space 78 is formed extending between the hub 72 and the rim 74 which has a constant circumferential dimension throughout its radial length. The space 78 in this example has a constant dimension throughout its length between the hub and the rim. In the views illustrated in FIGS. 13 and 14, the gauging surfaces 80 of each of the knives 30 can be seen. The food product is fed into the plane of the cutting wheel so as to maintain contact with the gauging surfaces of the knives as they pass through the food product. The dimension of the gate opening will accurately control the thickness of the sliced food product.

FIG. 14 illustrates the use of knives 30 on a cutting wheel having a hub 82 and a rim 84. The positioning and operation of the knives 30 is identical to the previously described example, the only difference being that hub 82 comprises known means to apply a tension to the knives 30 in the direction of arrows 86. As in the previously described drawing figure, the wheel rotates in the direction of arrow 76. Such tension hubs 82 are well-known in the art and need not be further described here. The tension forces exerted on the knife 30 will be exerted through the fasteners closest to the cutting edge, the second fastener on the rim end of the knife being used to clamp the trailing corner of the knife to the rim.

Figure 15:
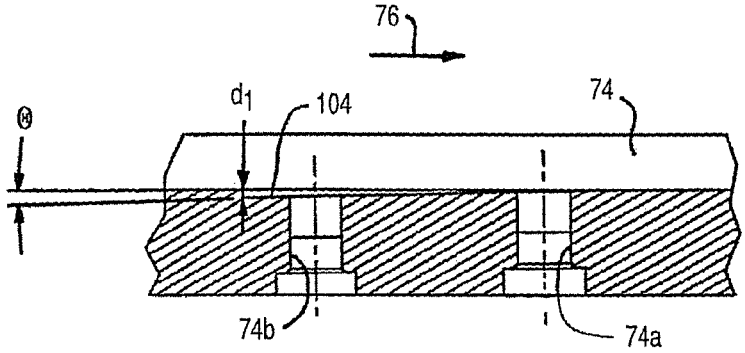
FIG. 15 PRIOR ART
FIG. 15, is a cross-sectional view taken along line XV-XV in FIG. 13.
Figure 16:
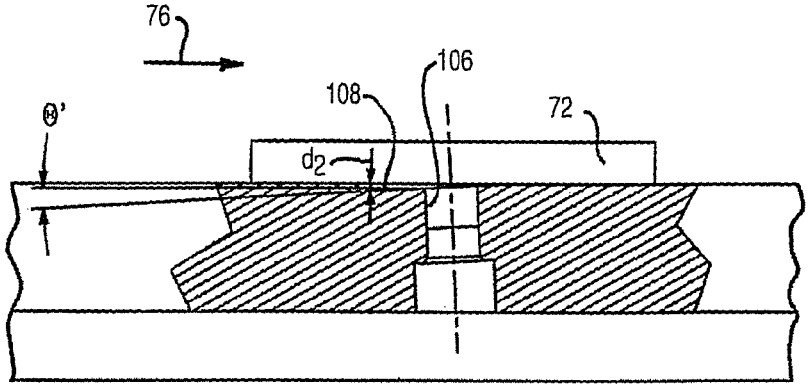
FIG. 16 PRIOR ART
FIG. 16, is a cross-sectional view taken along line XVI-XVI in FIG. 13.
Figure 17:
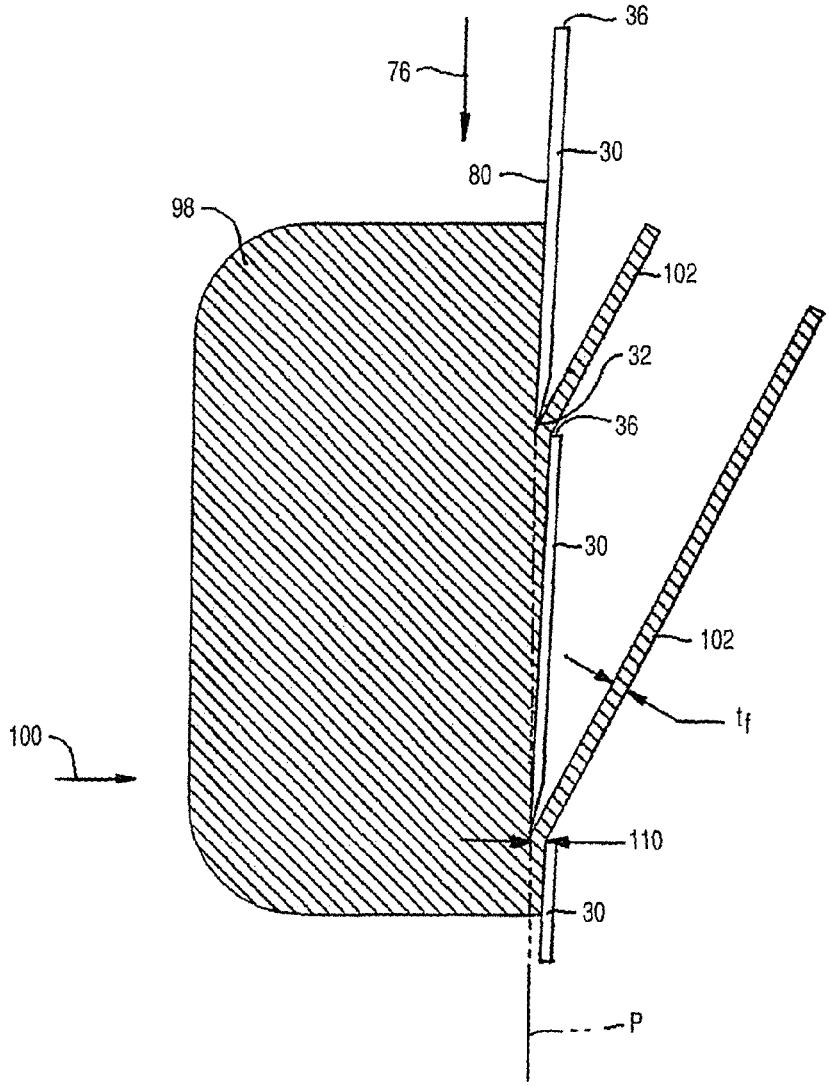
FIG. 17 PRIOR ART
FIG. 17, is a schematic, cross-sectional view illustrating the cutting action of the knives illustrated in FIG. 3.

FIGS. 15 and 16 are cross-sectional views taken along lines XV-XV and XVI-XVI in FIG. 13, respectively. These figures illustrate the rim 74 and the hub 72 to which the opposite ends of the knives 30 are attached and in conjunction with FIG. 17, illustrate how the gate opening is achieved using the single piece knives 30. The rim 74 has a knife attachment surface 104 that extends at a pitch angle θ to the opposite planar sides of the wheel rim 74. Holes 74*a* and 74*b* extend through the attachment surface 104 and are aligned with holes 40*a* and 40*b* of the knife 30. Fasteners (not shown) inserted through the respective holes attach the rim end of the knife 30 to the rim 74. Similarly, hole 106 formed in the hub 72 is aligned with hole 38 of the knife 30 and a fastener inserted through the respective holes attach the hub end of the knife 30 to the hub 72. Hub 72 has an attachment surface 108 configured to accommodate the hub end of the knife 30, the surface 108 extending at a pitch angle θ' with respect to the opposite parallel faces of the hub 72. The depth $d_1$ measured at the rearmost extremity of the surface 104 is equal to the corresponding depth $d_2$ measured at the rearmost extremity of the surface 108 to insure that the second edges 36 of the knives 30 are spaced from the cutting edges 32 of adjacent knives to form the gate openings.

FIG. 17 schematically illustrates the cutting action of the knives 30 as they pass through the food product 98. The cutting plane P of the cutting wheel is schematically illustrated and the knives 30 move in the direction of arrow 76 as the food product 98 is fed in the direction of arrow 100 through the cutting plane P. As can be seen, the gauging surfaces 80 of each of the knives 30 extends at an angle to the cutting plane P such that the distance between the cutting edge 32 of one blade and the juncture between the gauging surface 80 and the second edge 36 of an adjacent blade in a direction generally perpendicular to the cutting plane P forms the gate opening 110. The dimension of the gate opening 110 is substantially constant along the radial dimensions of the knives between the hub and rim. This dimension will accurately control and define the thickness $t_f$ of each of the food product slices 102.

Figure 18:
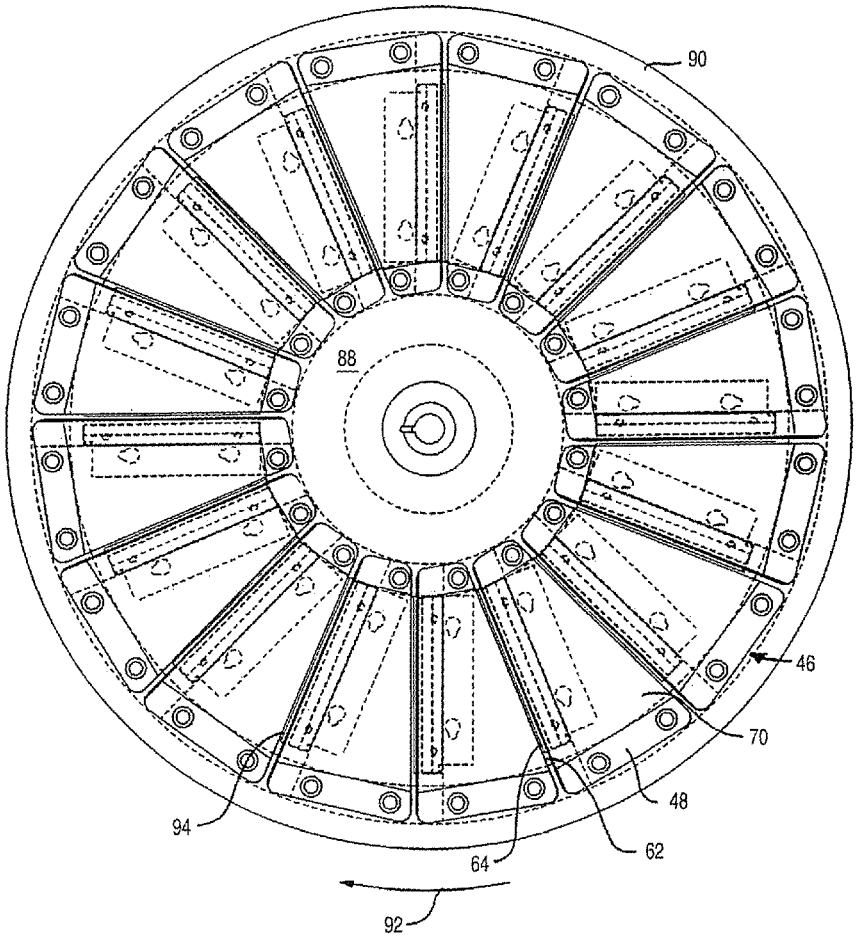
FIG. 18 PRIOR ART
FIG. 18 is a front view of a cutting wheel according to the present invention utilizing a plurality of knives illustrated in FIG. 7.

FIG. 18 is a front view illustrating a cutting wheel having a plurality of knives 46 attached thereto. Again, the cutting wheel comprises a hub 88 and a rim 90 to which the knives 46 are attached. A slicing system using such a cutting wheel is marketed by Urschel Laboratories, Inc. of Valparaiso, Ind., U.S.A. under the product name Translicer 2000 or 2500. As in the previously described illustrations, the cutting wheel rotates in the direction of arrow 92. A space 94 is formed between the second or trailing edge 62 of one knife 46 and the cutting or leading edge 64 of an adjacent knife 46 such that the space 94 has a substantially constant circumferential dimension throughout its radial length. The constant dimensions of the spaces 94 enable the food product to be sliced with increased accuracy than the known cutting wheels.

Figure 19:
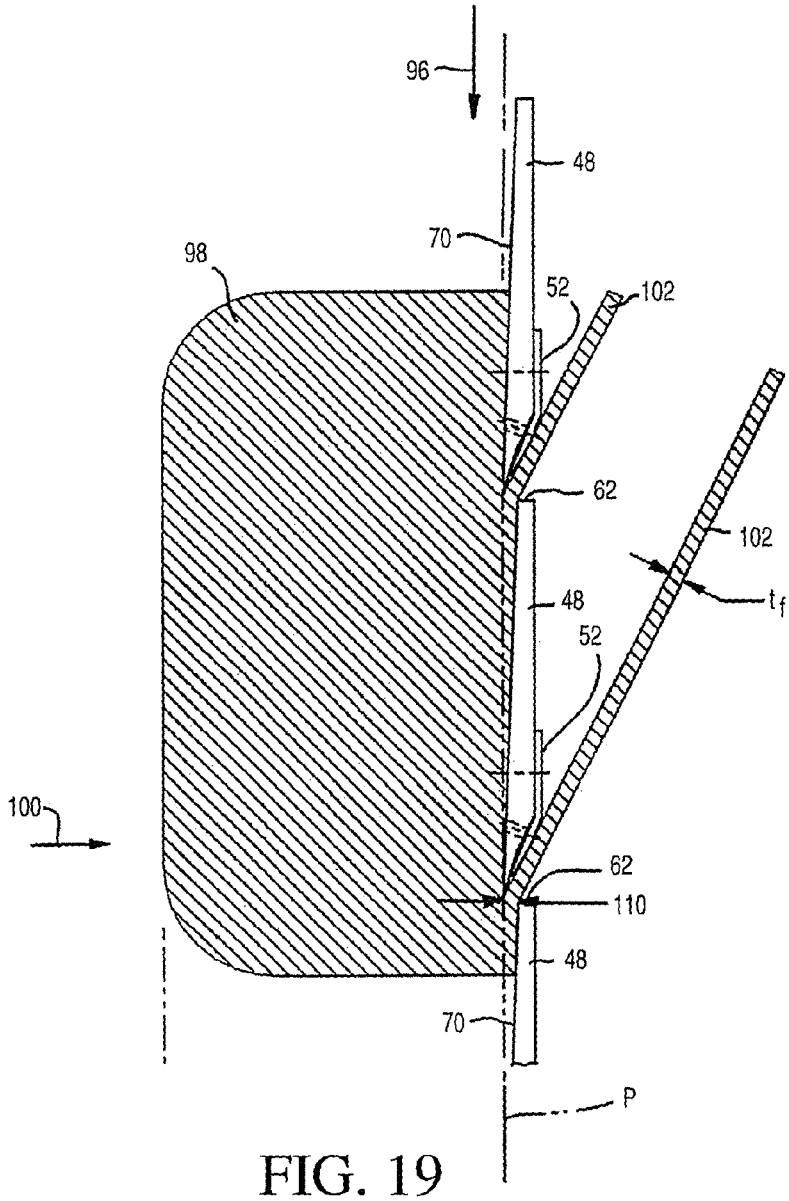
FIG. 19 PRIOR ART
FIG. 19 is a schematic, cross-sectional view illustrating the cutting action of the knives illustrated in FIG. 7.

The cutting action of the knives 46 (shown as an assembly of holder 48 and blade 50) passing through the food product is schematically illustrated in FIG. 19. The cutting plane of the cutting wheel is schematically illustrated at P and the knives move in the direction of arrow 96 as the food product 98 is fed in the direction of arrow 100 through the cutting plane P. As can be seen, gate opening 110 is formed by the distance between the cutting edge 64 of one knife 46, and the juncture of the gauging surface 70 and the second or trailing edge 62 of an adjacent knife 46 measured perpendicular to the cutting plane P (axially relative to the axis of rotation of the wheel). Gate opening 110 accurately controls and defines the thickness $t_f$ of each of the food product slices 102. The dimension of the gate opening 110 is substantially constant throughout the radial length of the knife blade 50.

Figure 8:
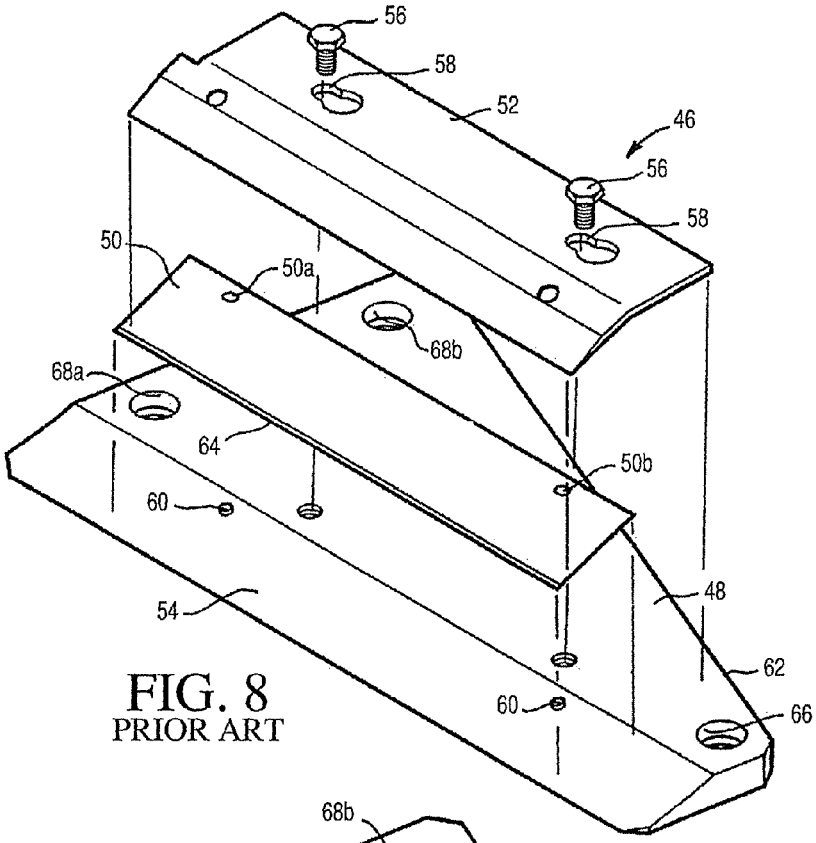
FIG. 8 PRIOR ART
FIG. 8 is an exploded view of the knife illustrated in FIG. 7.
Figure 7:
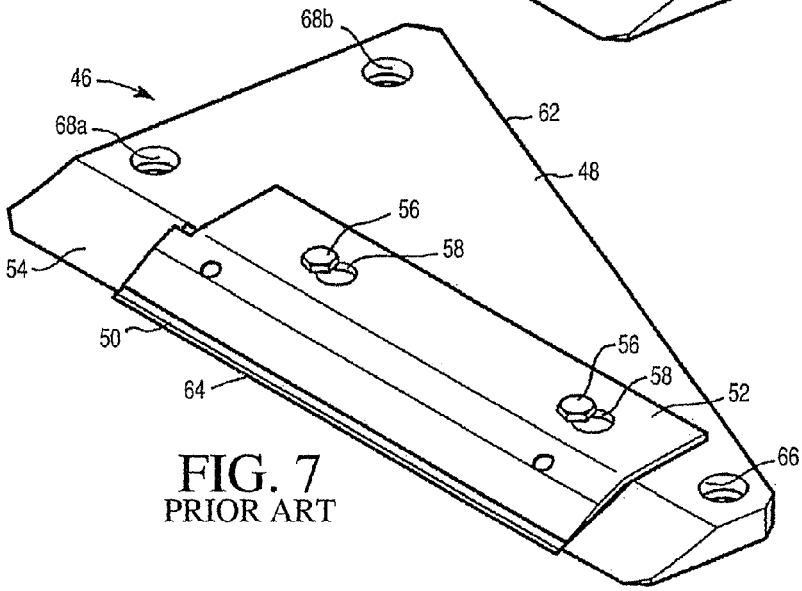
FIG. 7 PRIOR ART
FIG. 7 is a perspective view of another prior art knife.
Figure 20:
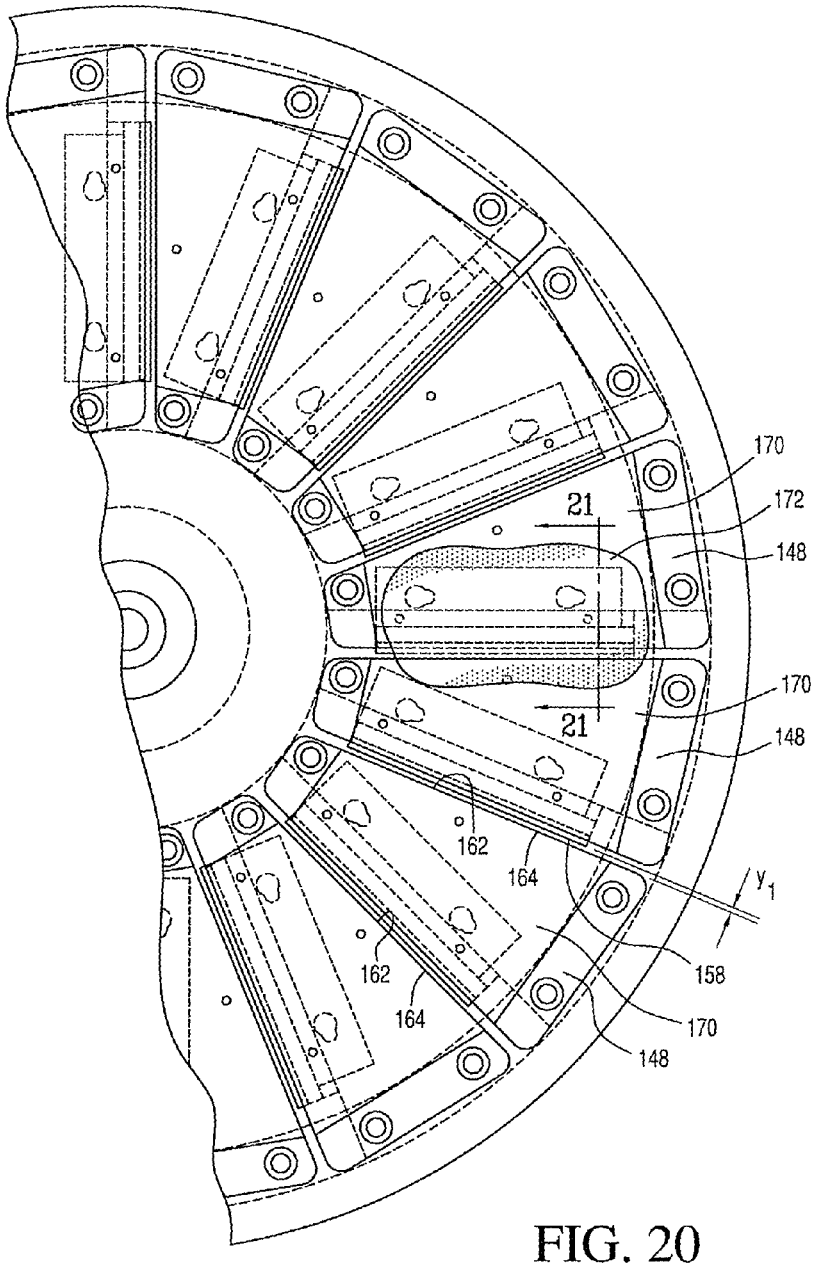
FIG. 20 PRIOR ART
FIG. 20 is a front view of a known cutting wheel with knives illustrating a throat dimension $y_1$.
Figure 21:
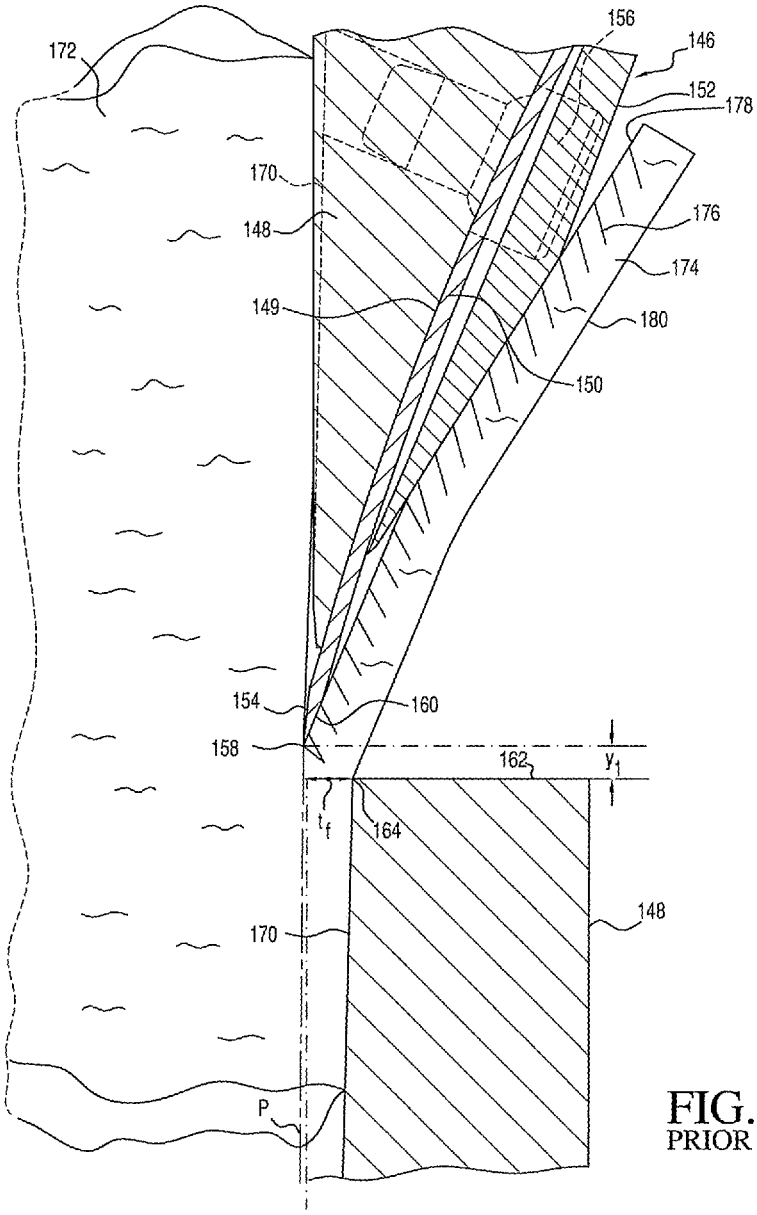
FIG. 21 PRIOR ART
FIG. 21 is a cross-sectional view taken along line 21-21 of FIG. 20.

With reference to FIGS. 20 and 21, in accordance with the present invention, a modified form of the knife 46 shown in FIG. 8 is depicted as knife assembly 146 with clamp 152 and fastener 156 arranged in a manner similar to that depicted in FIG. 8 with reference to the clamp 52 and the fastener 56. The knife holder 148 corresponds to knife holder 48 in FIG. 8 modified to provide an arcuate support surface 149 for knife element 150 shown fully seated against the support surface 149 under the clamping force of clamp 152 urged by fastener 156 that is threadedly engaged with the holder 148 such that tightening of fastener 156 causes clamp 152 to urge knife 150 towards the support surface 149 to varying degrees as will be discussed below. In this view, the knife 150 is urged by clamp 152 into full engagement with the concave arcuate seat 149 of holder 148.

The knife 150 also includes a double beveled cutting edge 158 including first and second essentially equal primary beveled surfaces 154, 160 corresponding to a prior art knife cutting edge configuration.

In FIG. 21, the area of gate opening 110 shown in FIG. 19 is illustrated in an enlarged format to reveal details about the geometry of the "throat" area between the intersection or junction of the terminal trailing end 164 of the gauging surface 170 on the one hand, and the cutting edge 158 of blade 150, on the other hand, measured parallel to the cutting plane P. In this instance, the terminal trailing end of gauging surface 170 meets the trailing or terminal edge 162 of holder 148 at the edge 162. (The term "trailing edge" of the knife refers to that edge of the knife including its holder, if a holder is provided, that is opposite the cutting edge area of the respective knife at the trailing terminal extremity of the knife).

As noted previously, the slicing thickness $t_f$ essentially corresponds with and is defined by the dimension of the gate opening 110, but it is common to refer to the dimension $y_1$ between the junction 164 and the cutting edge 158 of knife 150 measured parallel to the cutting plane P as a "throat" dimension, as illustrated. In this example, the throat dimension $y_1$ is shown located in accordance with prior art arrangements where the junction 164 typically is a sharp edge located as close to cutting edge 158 as is practical to precisely control the thickness of a slice 174 taken from a whole food product 172, for example a potato that has been advanced to the cutting plane P by an appropriate feed mechanism associated with a cutting wheel incorporating the assembly of knives as depicted in FIG. 20.

In accordance with prior art design philosophy, precise control over the thickness of slices 174 was considered to be a critical design criterion due to the demand by the potato chip industry, for example, to produce uniform slices of food products that could be consistently processed, for example by frying in oil, in a uniform manner.

The use of the gauging surface 170 and the overall configuration of the knives and their holders effected such desired precise control over slice thickness of food products cut by the apparatus, but feathering along the inboard side 178 (the side facing the knife or uncut food product) of the cut edge of the slices 174 as manifested by fissures or cracks 176 extending approximately 45° relative to the cut surface in the direction of slicing were observed during high speed cutting and resulted in adverse effects when the slices were fried in oil.

The fissures 176 that are distributed along the inboard sliced surface 178 of slices 174, it is theorized, permitted entry of oil into the interior of the inboard surface to a greater extent than the outboard surface 180 of the slice.

Such unequal exposure to frying oil during the frying process is believed to cause excessive curling of the slice to the extent, in some instances, that the slices literally fold over themselves so that the outer surface 180 (opposite the inboard surface) of one portion of the slice folds over and contacts the outer surface of the slice at another location.

The phenomenon of fissure production during high speed slicing has been known in the art for many years and various solutions have been proposed to minimize or eliminate such fissures in different slicing systems. Upon detailed investigation, it was observed that enlarging the throat dimension $y_1$ while maintaining slice thickness within a preferred range, in combination with a preferred knife cutting edge design, has a beneficial effect on minimizing or practically eliminating production of fissures 176, thereby improving the quality and appearance of slices 174 after frying in oil.

Figure 22:
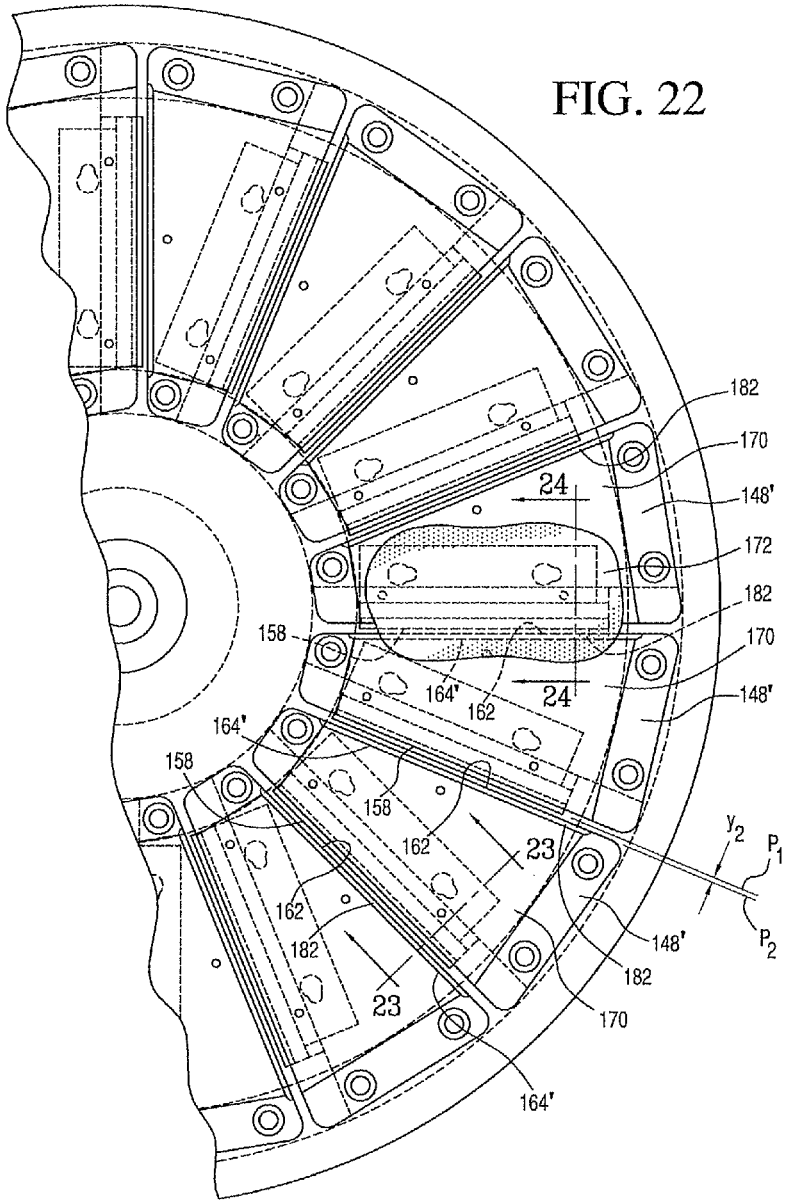
FIG. 22 is a front view of a cutting wheel according to this invention showing a modified throat dimension $y_2$.
Figures 23, 23A:
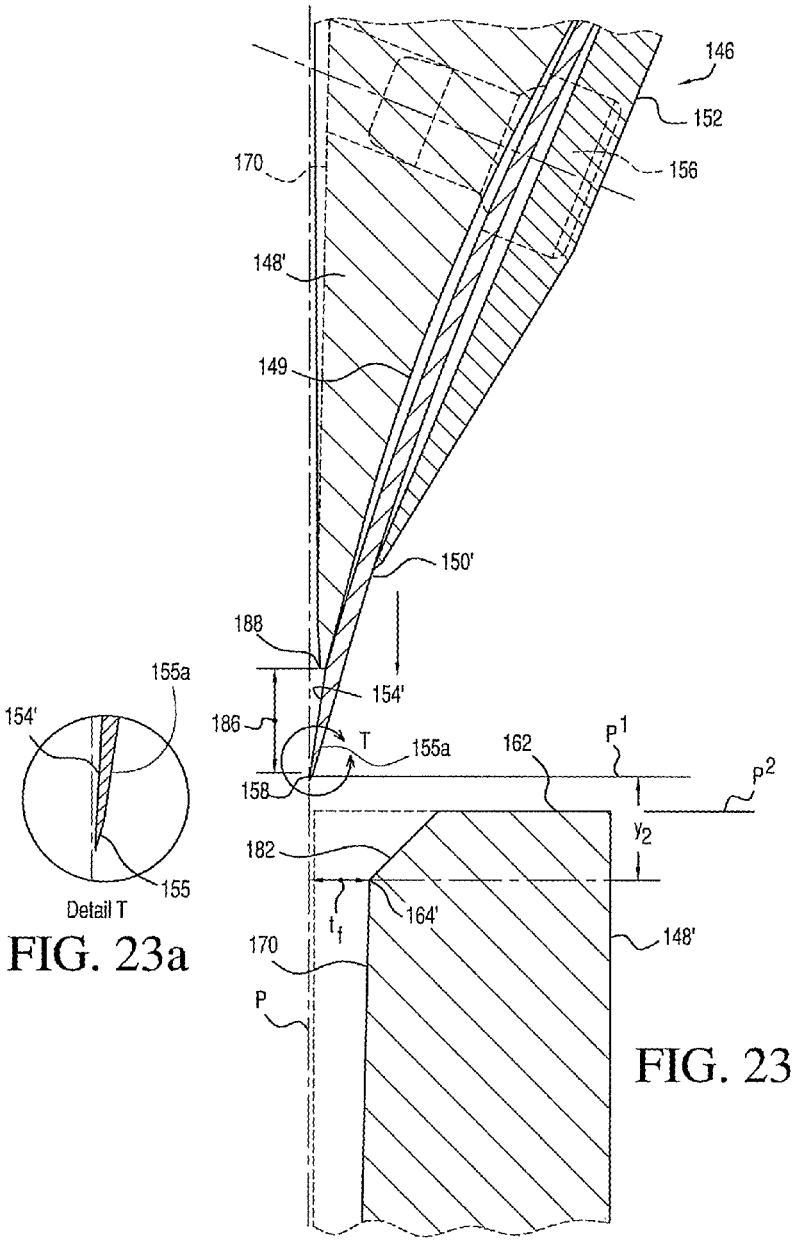
FIG. 23 is a cross-sectional view taken along line 23-23 in FIG. 22.
FIG. 23*a* shows detail T in FIG. 23 enlarged.

More specifically, it was observed that enlarging the throat dimension as depicted at $y_2$ in FIGS. 22, 23 while not substantially enlarging the slicing thickness and changing the bevel configuration of the knife resulted in a marked reduction of production of fissures 176 during high speed slicing of potatoes. It is believed that this principle is effective as well with other hard core food products prone to develop fissures along the inboard cut surface of slices produced during high speed slicing.

To effect enlarging of the dimension $y_1$ to a higher value $y_2$, while not moving the gauging surface 170 (thereby maintaining slice thickness) the terminal end 164' of gauging surface 170 was moved away from the knife cutting edge 158 to effectively move the terminal end 164' away from the trailing edge surface 162 of holder 148, for example by beveling the area of the original junction 164 with the trailing edge 162 of holder 148 shown in FIG. 21 as shown at beveled surface 182 in FIGS. 22, 23, 24 and 25. While the bevel surface 182 is depicted as extending approximately 45° relative to either surface 162 or 170, the specific angle of inclination of the surface 182 is not believed to be critical, nor is it critical that the surface 182 be precisely planar. The terminal end 164' thus is moved away from a transverse plane $p^2$ including edge 162 and away from plane $P^1$, as shown.

What is critical is that the dimension $y_2$ be moved back from the plane $p^1$ including cutting edge 158 of blade 150' to produce a suitable desired dimension $y_2$ of the throat area while not affecting slice thickness $t_f$ substantially. Thus, while the slicing thickness remains the same with both dimension $y_1$ and $y_2$, appreciable reduction in the production of fissures 176 was observed, provided that a ratio between slicing thickness $t_f$ and throat dimension $y_1$, $y_2$ is maintained, further when the improved knife bevel configuration is used.

Specifically, it was observed that a ratio of throat dimension $y_1$ or $y_2$ to slice thickness $t_f$ of 1 to 1.7 with the improved knife bevel configuration to be described below resulted in an acceptable variation of slice thickness precision and consistency and a substantial reduction of production of fissures 176 in the slice 174.

Figure 24:
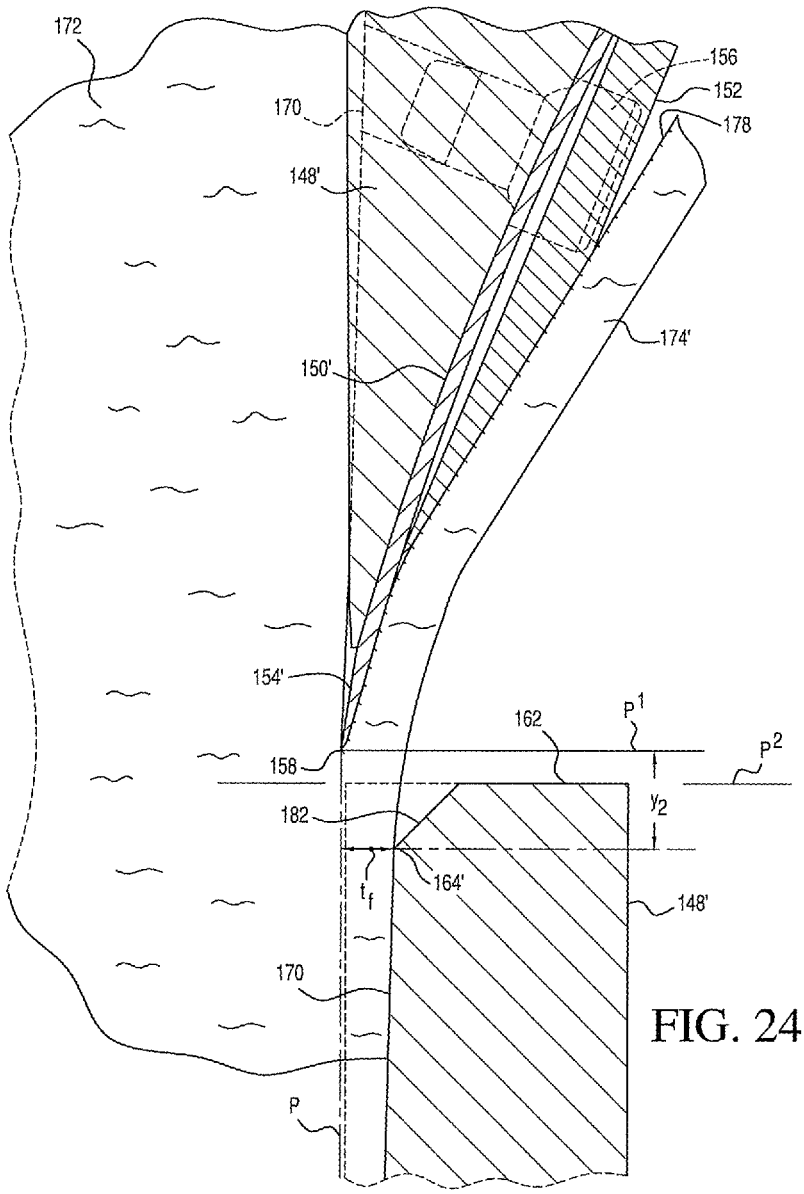
FIG. 24 schematically illustrates the effect of changing the throat dimension from $y_1$ to $y_2$ and using a knife constructed in accordance with the invention to slice a food product.
Figure 25:
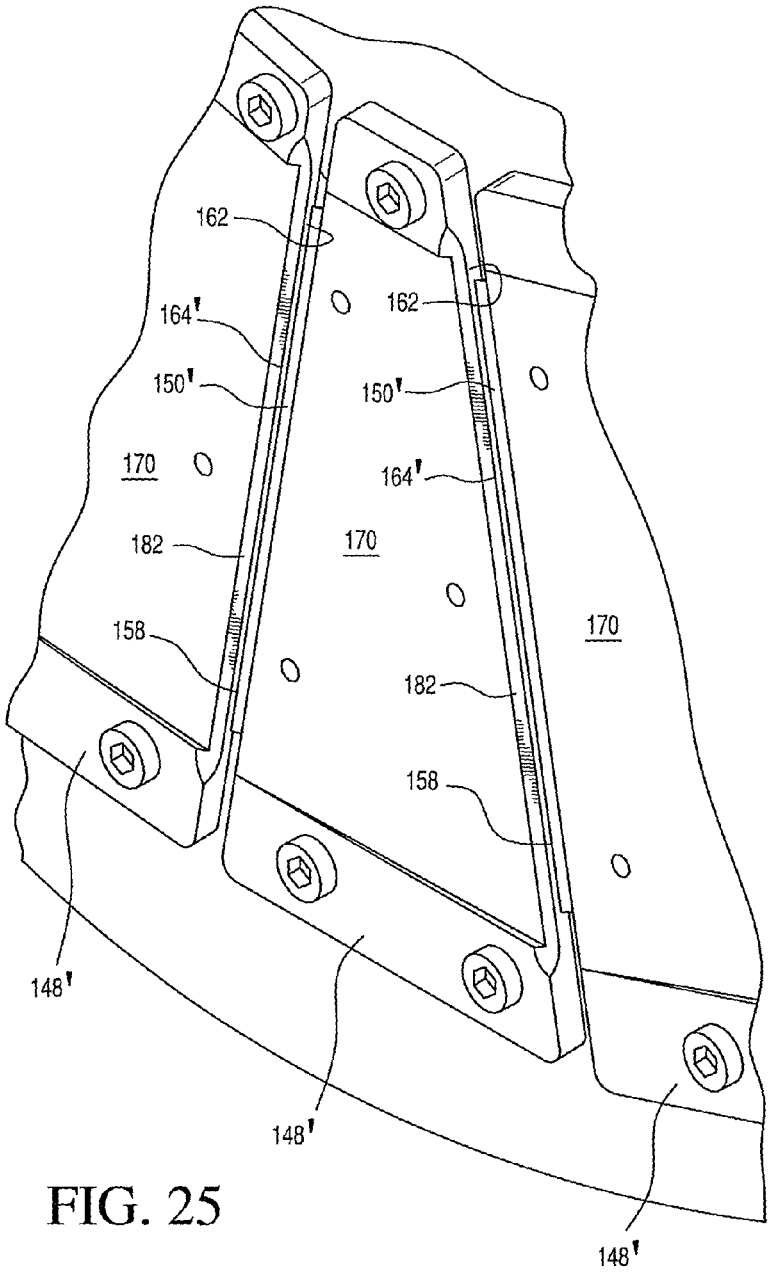
FIG. 25 is an enlarged detailed perspective view showing the throat area between knives of FIG. 22.

As shown in FIG. 24, a slice 174' produced with the inventive knife assembly including clamp 152 and knife blade element 150' using an improved bevel configuration supported in holder 148' arranged to produce a slicing thickness $t_f$ with a throat dimension $y_2$ within the ratio of 1 to 1.7 had for fewer fissures on the inboard surface 178 as compared with a smaller throat dimension $y_1$ and prior conventional knife bevel configuration producing essentially the same slicing thickness $t_f$ shown in FIG. 21, but with a throat to slice thickness ratio outside the design limit of 1 to 1.7.

It is theorized that the cellular structure of the sliced food product such as a potato reacts adversely to high speed impact of a slicing knife 150 having the usual double bevel. The sudden impact to the cellular structure of the food product is reacted by the production of the fissures 176 particularly along the outer bevel side of the cutting edge that faces the sliced product.

Irrespective of the theoretical cause of the fissures, a solution to the problem has been achieved at least in part by establishing an optimum throat dimension $y_2$ relative to a slicing thickness $t_f$, as described above, in combination preferably with a modified beveled knife edge to be described below.

As a further enhancement leading to the substantial reduction of fissures 176, the cutting edge 158 of knife element 150' (shown in FIG. 23 as a knife blade element) includes a single primary bevel surface 154' on the side thereof facing the uncut food product and the resulting primary bevel surface is elongated compared to each of the prior art double bevel surfaces. The knife blade element is supported so that the single primary bevel 154' extends practically (as close as practical) tangent to the cutting plane P. The planar opposed side 155*a* of knife blade element 150' adjacent the cutting edge 158 and the side with the primary bevel 154' are provided only with a small finish back hone bevel 155 as shown in FIGS. 23 and 23*a* to provide a sharp, maintainable cutting edge of the knife blade element. The small back hone bevel surfaces 155 (FIG. 23*a*) extend at a steeper bevel angle than primary bevel 154'; are substantially smaller than major bevel 154', and lie directly adjacent the cutting edge 158. A smooth transition of the slice 174' away from the uncut food product 172 results on the outer planar side 155*a* of knife blade element 150' opposite the gauging surface, thereby decreasing the cutting pressure at the point of slicing impact between the knife blade element and the food product. It is believed that the reduction of fissures 176 during slicing results from the ratio of slicing thickness $t_f$ to throat dimension $y_2$ of 1 to 1.7 and the use of a single primary cutting edge bevel extending approximately tangent to the knife cutting plane, with a smooth planar surface opposite the primary bevel.

As a further enhancement in slice thickness control, the position of the cutting edge 158 relative to the terminal trailing end 164' of the gauging surface 170 of the respective holder 148' can be varied to a greater extent, it was observed, if the knife blade extension 186 was elongated as compared with prior art knife extensions. The knife blade extension dimension 186 is that portion of the cutting edge area of knife blade 150' that extends beyond the terminal leading edge 188 of holder 148'.

This effect is obtained because the knife blade element 150' is retained on holder 148' by means of a clamp 152 that may be urged against knife blade element 150' in a variable manner depending upon the torque applied to fastener 156. That is, knife blade element 150' is normally flat but bends due to its flexibility as it is urged by clamp 152 under influence of fastener 156 towards concave arcuate support surface 149 of holder 148'. Normally, the blade element 150' is not fully seated against the support surface 149, but is bent in arcuate manner as illustrated towards the support surface 149 under the influence of torque applied to fastener 156 transmitted through clamp 152. The portion of knife blade element 150' lying above the support surface 149 and beneath the fastener 156 is urged in varying degrees towards the support surface 149, but the terminal leading edge 188 of holder 148' effectively acts as a fulcrum in contact with a distal area of the knife blade element causing the cutting edge 158 to move in the opposite direction to that portion of the knife blade element 150' lying beneath fastener 156.

By providing an elongated knife blade extension dimension 186 and varying the torque applied to fastener 156, the position of cutting edge 158 relative to the gauging surface 170 can be adjusted with high precision to thereby control the slicing thickness $t_f$ of a food product sliced by the apparatus embodying the invention, and alignment of all the knives of the cutting wheel.

For example, prior art adjustment of the position of the cutting edge 158 relative to the gauging surface 170 (or the terminal end 164') was on the order of 0.004 in. (0.1 mm). Forming the knife extension 186 with a longer dimension and reducing the radius of curvature of the support surface 149 enabled the position of the cutting edge 158 to be adjustable on the order of 0.006 in. (0.15 mm). Thus, for each incremental change of torque applied to fastener 156, a greater range of adjustment of the position of knife edge 158 relative to terminal end 164' is obtained.

Figure 26:
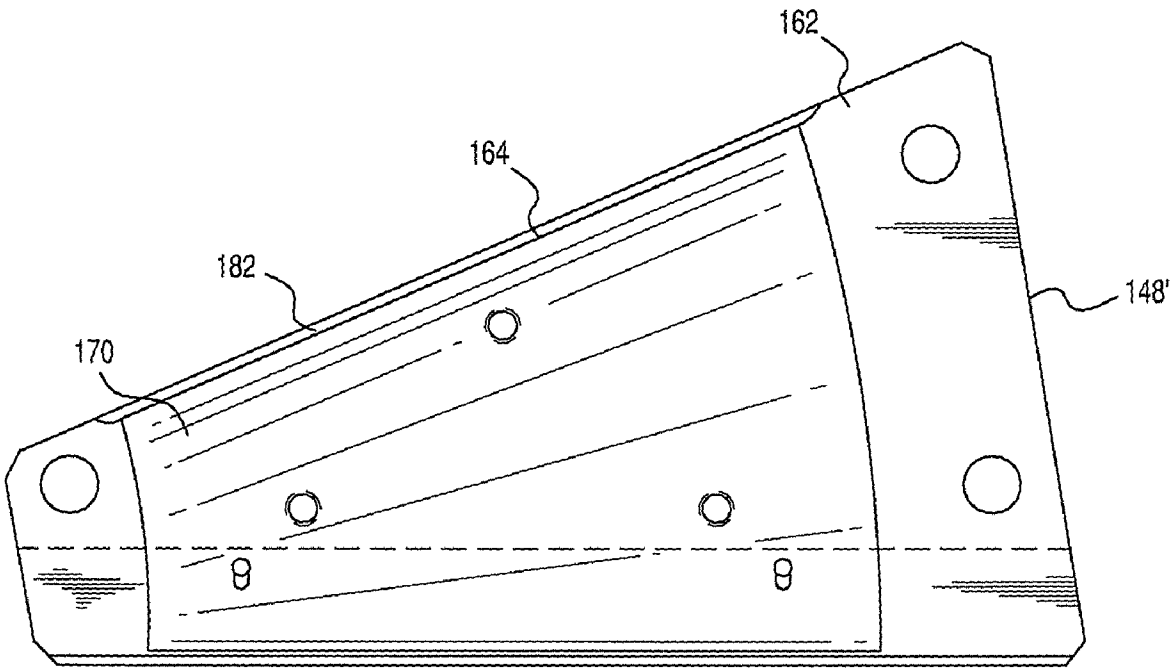
FIG. 26 is a plan view of a knife element holder embodying the invention.

FIG. 26 shows a plan view of knife holder 148' with a beveled surface 182 adjacent the juncture of the rear or trailing edge 162 of the holder and the terminal end 164' of gauging surface 170, revealing that the beveled surface 182 extends at least over the full length of the area of intersection of the terminal trailing end of gauging surface 170 with the trailing edge 162 of holder 148'.

Figure 27:
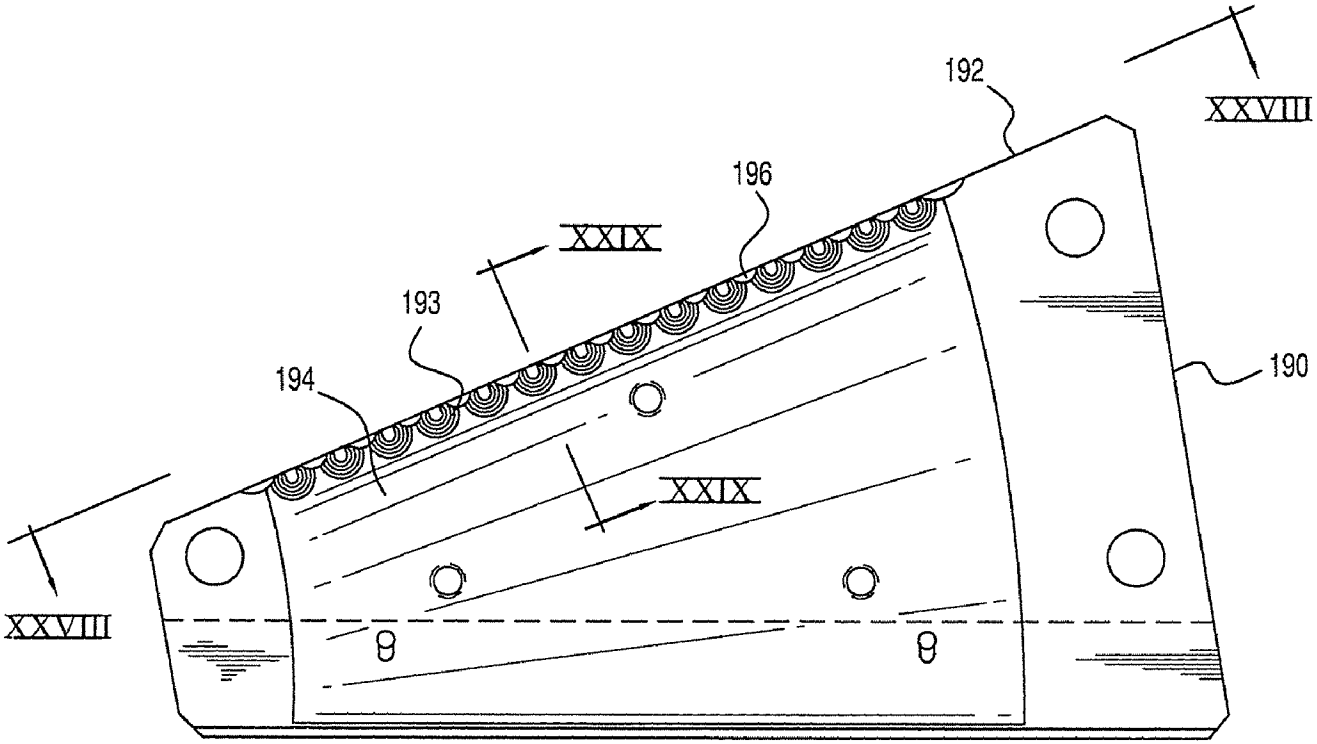
FIG. 27 is an alternate embodiment of the knife element holder illustrated in FIG. 26.

FIG. 27 shows an alternate embodiment 190 of the knife holder wherein circular indentations 193 are machined or otherwise produced along the trailing edge 192 of the knife holder 190 along the intersection of a gauging surface 194 corresponding to gauging surface 170 shown in FIG. 23 and the trailing edge 192. The indentations 193 permit sand and hard debris to escape between a cutting edge of a knife trailing behind the trailing edge 192 in a cutting wheel in which the holder 190 is assembled with a knife blade as described above. A beveled edge 196 as shown in FIG. 28 is also provided at the transition of the trailing edge 192 and the terminal trailing end of gauging surface 194, in the same manner as depicted in FIG. 23 illustrating the knife holder 148', as shown best in FIG. 29.

Figure 28:
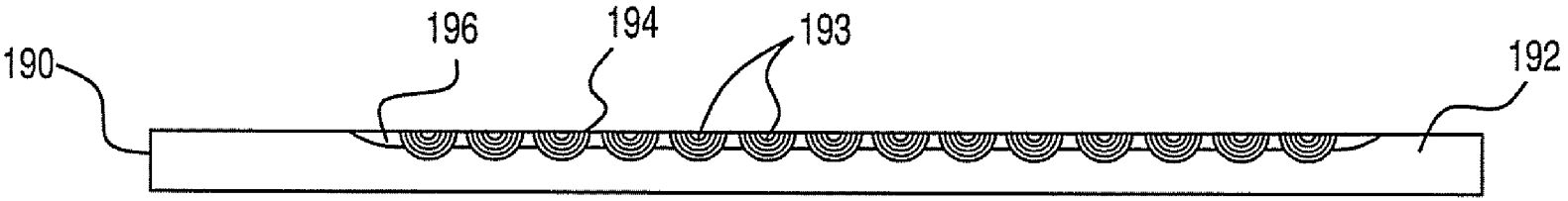
FIG. 28 is a view taken along line XXVIII-XXVIII in FIG. 27.
Figure 29:
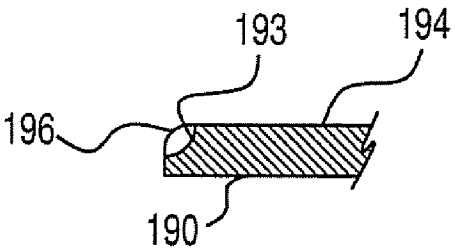
FIG. 29 is a partial section view taken along line XXIX-XXIX of FIG. 27.

FIG. 28 is a view taken along line XXVIII-XXVIII of FIG. 27, and FIG. 29 is a view taken along line XXIX-XXIX shown in FIG. 27, these views showing the indentations 193 and the bevel 196 in more detail.

A cutting wheel configured in the manner shown in FIGS. 22 and 23 was installed in a model XPS rotary cutting wheel type slicer produced by Urschel Laboratories, Inc. of Valparaiso, Ind., wherein the knife elements included a gauging surface of the kind described above, and the knife elements comprised 0.015 in. (0.4 mm) hardened high carbon steel sheets sharpened along a cutting edge using only one primary bevel set at 8.5° relative to the plane of the knife element producing a primary bevel surface having a width of 0.080-0.100 in. (2-2.5 mm) from the cutting edge to the unbeveled surface of the knife element. The knife element width after sharpening was 0.740-0.745 in. (18.8-18.9 mm) and the cutting edge was honed and back honed 12-13° per side equally. The slicing thickness $t_f$ was set at a nominal 0.053 in. (1.35 mm) and the throat dimension $y_2$ was set at 0.090 in. (2.3 mm). The cutting speed typically was 100-200 RPM. Sixteen knives were mounted on the cutting wheel, which in this slicing machine states in a horizontal plane. The throat dimension to slice ratio was 1.7. Slices of raw potatoes produced using this configuration showed substantial decrease in feathering cracks compared with prior art slicing wheel configurations, and acceptable slicing thickness variations of slices from the nominal thickness setting were acceptable.

Additional testing revealed that adjustments of throat dimension to 0.060 in. (1.5 mm) using the same knife configuration and a slicing thickness of 0.053 in. (1.35 mm) also resulted in very good slice thickness variations, but the reduction of feathering cracks approached only a margin of acceptability. The ratio of throat dimension to slicing thickness in this case was 1.1.

From the test data it was concluded that the use of the single primary 8.5° bevel cutting edge knife located with the bevel surface as close as practical to the cutting plane of the wheel in combination with a throat dimension to slice thickness ratio of 1 to 1.7 produced the most preferred embodiment of the invention and resulted in potato slices having both acceptable feathering frequency and depth and slice thickness variation. The use of circular cut indentations ("sand gates") along the cutting edge of the preferred configuration did not materially affect the acceptability of the slices with regard to the density of feathering, and slice thickness variation was acceptable. Similar results are believed to be obtainable using the same cutting wheel on a slicing machine wherein the wheel rotates in a vertical plane with a single product feed zone such as an Urschel Translicer 2000 or 2500 slicing machine produced by Urschel Laboratories, Inc. of Valparaiso, Ind.

Figure 31:
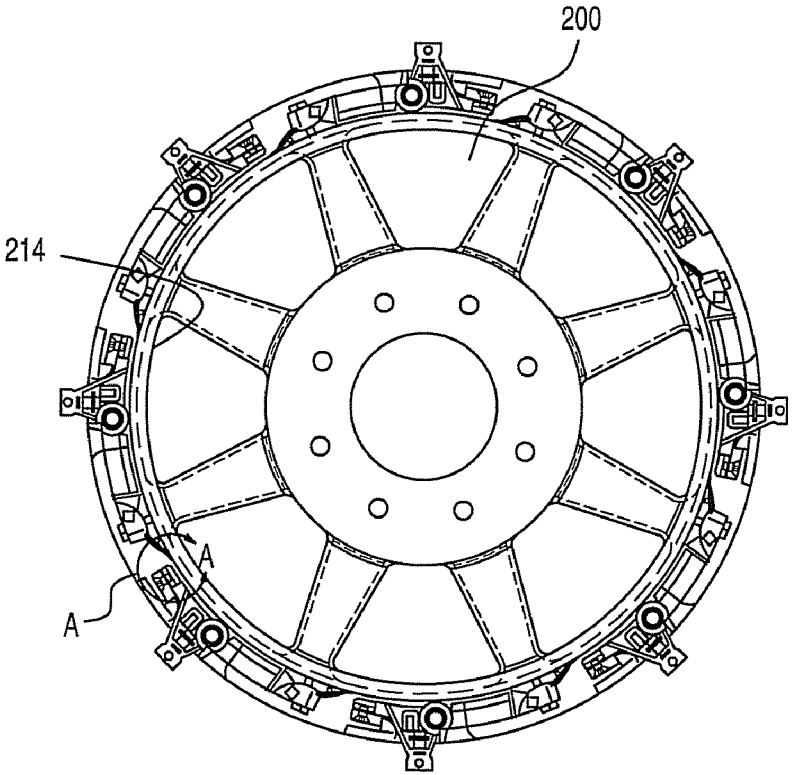
FIG. 31 is an enlarged detail view of area A shown in FIG. 30.
Figure 30:
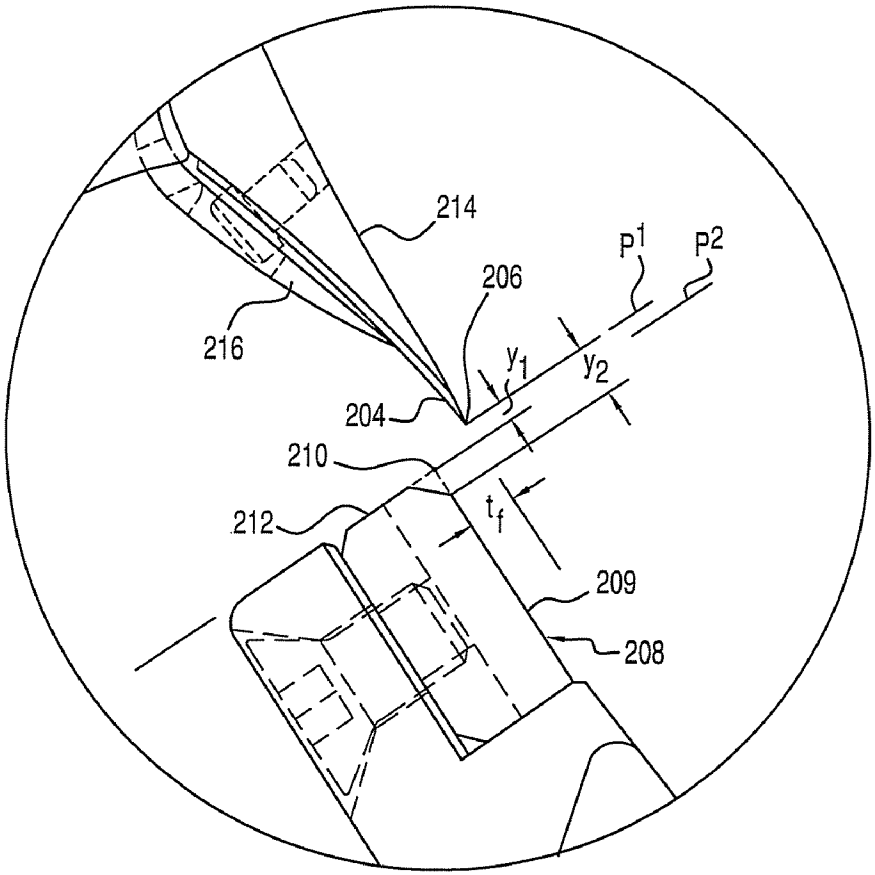
FIG. 30 shows an alternate form of the invention used in an annular food slicer utilizing fixed blades.

Another application of the invention is illustrated in FIGS. 30 and 31. FIG. 31 represents a drum type food slicer of the type illustrated in U.S. Pat. No. 5,694,824 owned by the owner of the present invention, and which is incorporated herein by reference.

The slicing apparatus disclosed in U.S. Pat. No. 5,694,824 slices food products by rapidly moving a product peripherally about an interior annular cutting area including knives circumferentially spaced about the annular cutting area such that the food products are centrifugally impelled against the cutting edges of the knives to produce slices that are discharged outside of the annular cutting area.

As shown in FIG. 31, food products are received in a central annular chamber 200 and are impelled by pusher blades (not shown) about the interior of the chamber in a clockwise direction. Knives 214 are circumferentially spaced about the chamber 200 as shown at the detail A illustrated in FIG. 30 and have cutting edges extruding somewhat inwardly into the cutting area.

FIG. 30 is a detailed view of section A of the cutting assembly shown in FIG. 31, wherein stationary cutting knife blades 204 cut slices having a thickness $t_f$ from food products driven against the cutting edge 206 of the knife 204. A system of this type is marketed by Urschel Laboratories, Inc. of Valapariso, Ind., as Model CC.

Replaceable gauging insert elements 208 include gauging surfaces 209 that function in the same manner as gauging surface 170 shown in FIG. 24 and the throat dimension $y_1$ in accordance with the prior art was set at a minimum value to provide maximum control over slice thickness.

In accordance with this invention, the throat dimension $y_1$ adjacent the "trailing" edge 212 of element 208 adjacent cutting edge 206 was enlarged to $y_2$ by providing a bevel cut at the junction 210 of the terminal edge of gauging surface 209 and the transverse plane $p_2$ including edge 212 of the element 208. In this manner, the desired ratio of throat dimension to slice thickness described above 1 to 1.7 was obtained to reduce formation of fissures in the sliced food products.

In accordance with this embodiment, the construction of the knife 204 and its respective holder and clamp 214, 216, are carried out in accordance with the corresponding knife, holder and clamp structure as shown in FIGS. 23, 24, in particular the single primary bevel arrangement as shown in FIG. 23*a*. In this instance the major bevel is located on that side of knife blade 204 facing the interior 200 of the slicing apparatus and extends in a direction as close as practical to the direction of motion of food product relative to the cutting edge 206, in a manner as described previously with respect to a cutting plane of a circular wheel cutter system.

The foregoing description is provided for illustrative purposes only and should not be construed as in any way limiting this invention, the scope of which is defined solely by the appended claims.

I claim:

1. In a food cutting apparatus including an annular arrangement of circumferentially spaced knives having axially extending cutting edges disposed around an axially extending annular product receiving area and gauging insert elements having gauging surfaces facing the product receiving area disposed in radially spaced relationship relative to said cutting edges to define thickness gate openings, the dimension of said gate openings defining a slice thickness of a food product, and throat spaces each having a throat dimension extending circumferentially between said cutting edges and terminal ends of said gauging surfaces, the cutting edge of each knife extending parallel to a terminal edge of a next adjacent gauging insert element; the improvement wherein the ratio of the throat dimension to slice thickness is 1 to 1.7; wherein the terminal end of the gauging surface of each knife is connected to the terminal edge of the insert by a surface extending in a forward or downstream direction relative to sliced food product movement between the terminal end of the gauging surface and the terminal edge of the insert; and wherein said surface is defined by a bevel at the terminal edge of the insert.

2. The improvement in a food cutting apparatus according to claim 1, wherein each said knife extends in a principal plane and includes a planar area extending along its cutting edge facing away from the insert gauging surface and a single primary bevel only along the cutting edge facing towards the insert gauging surface, a final hone bevel along the cutting edge on the side of said cutting edge including said primary bevel, and a back hone bevel along the side of the cutting edge of said side including the primary bevel; wherein said primary bevel is inclined 8.5° relative to the knife principal plane and said final hone bevel and back hone bevel each extend 12-13° relative to the principal plane, and further wherein said knife comprises a hardened high carbon steel sheet element measuring 0.015 in. (0.4 mm) thick, and wherein said primary bevel is 0.080-0.100 in. (2-2.5 mm) wide from the cutting edge to an intersection of the bevel with a knife non-beveled outer surface.

* * * * *